United States Patent [19]

Volkers

[11] 3,994,725

[45] Nov. 30, 1976

[54] METHOD FOR ENHANCING REMOVAL OF BACKGROUND TONER PARTICLES

[75] Inventor: Stewart William Volkers, Williamson, N.Y.

[73] Assignee: Xerox Corporation, Stamford, Conn.

[22] Filed: Sept. 13, 1974

[21] Appl. No.: 505,706

Related U.S. Application Data

[62] Division of Ser. No. 371,109, June 18, 1973, abandoned.

[52] U.S. Cl. ..... 96/1.4; 96/1 SD; 427/14; 427/24; 96/1 R

[51] Int. Cl.[2] ..... G03G 13/14

[58] Field of Search ..... 96/1 SD, 1 R, 1.4; 117/17.5; 427/25

[56] References Cited

UNITED STATES PATENTS

| | | | |
|---|---|---|---|
| 3,041,167 | 6/1962 | Blakney et al. | 96/1.4 |
| 3,146,100 | 8/1964 | Kaufman | 96/1 R |
| 3,244,083 | 4/1966 | Gundlach | 96/1 TE |
| 3,764,207 | 10/1973 | Obuchi | 96/1.4 |
| 3,784,300 | 1/1974 | Hudson | 96/1 R |
| 3,807,997 | 4/1974 | Cade | 96/1 SD |

*Primary Examiner*—Roland E. Martin, Jr.
*Assistant Examiner*—John L. Goodrow

[57] ABSTRACT

In an electrostatic copying apparatus, background toner particle removal is enhanced by employing a corona emission device between a development station and a background toner removal station. The corona emissions are such as to substantially reduce the background residual potential on a photoconductor and ensure that all background particles on the photoconductor are of a polarity opposite to the polarity of the charge on the latent image whereby toner particles may be more easily removed from the photoconductor surface.

3 Claims, 1 Drawing Figure

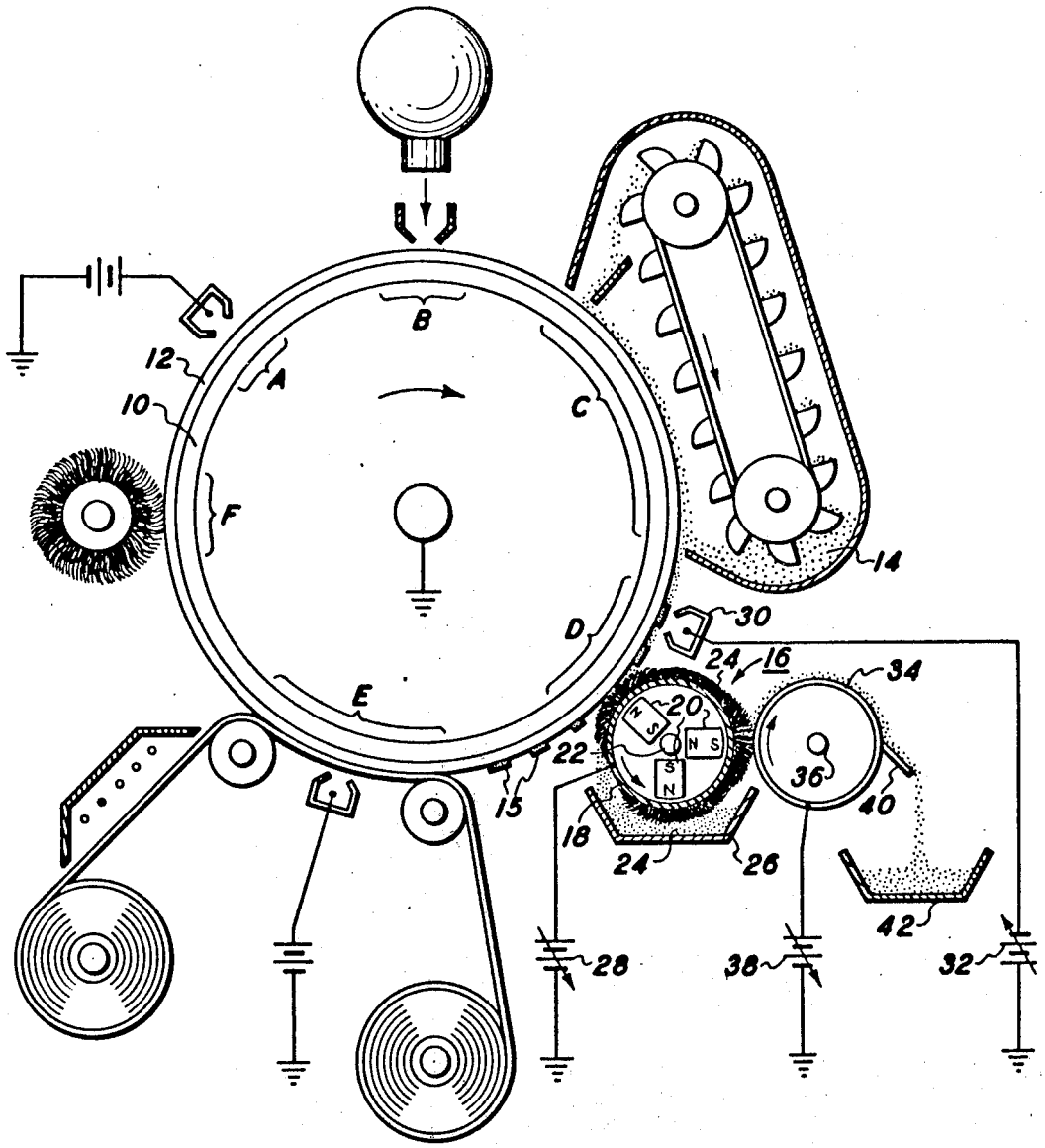
B
12
A
10
C
F
14
30
D
24
16
34
E
20
N
S
22
36
15
40
18
24
26
42
28
38
32

METHOD FOR ENHANCING REMOVAL OF BACKGROUND TONER PARTICLES

This is a division of application Ser. No. 371,109, filed June 18, 1973 now abandoned.

In a xerographic copier, a photoconductor has an electrostatic latent image thereon which is developed by toner particles. Frequently, toner particles stick to the background area of the photoconductor and are transferred to a copy sheet, which is undesirable. Many methods have been proposed to prevent the toner particles adhering to the background areas of the photoconductor from transferring to a copy sheet. One such method is to subject a developed image to corona emissions prior to the transfer of the developed image to a copy paper. The corona emissions are of such a nature that the polarity of the toner particles is changed to the same polarity as the charge on the latent image. During transfer of the toner particles forming the developed image to a copy paper, an electrostatic field is established which inhibits the attraction of the toner particles in the background to the paper such as shown by U.S. Pat. No. 3,444,369. The background toner particles as well as any other residual toner particles remaining on the photoconductor are then removed at a cleaning station. Other methods have been proposed whereby a fur brush wipes over the developed image to remove toner particles from the background areas prior to transferring the toner particles forming the image to a copy sheet such as shown by U.S. Pat. No. 3,632,370. Another method has been proposed wherein a cleaning powder is carried by a magnetic brush which removes the toner particles forming the image being transferred to a copy sheet such as shown by U.S. Pat. No. 3,592,675.

It is an object of this invention to provide a mechanism which renders the toner particles adhering to the background area of a photoconductor more receptive to removal therefrom prior to transferring a developed image to a copy sheet.

It is proposed to effect the above object by subjecting the toner particles forming the background and image to corona emissions which is of such nature that (1) the residual background charge on the photoconductor is reduced to the extent that the background potential is substantially reduced and (2) the the toner particles in the background area all obtain or maintain charges having a polarity opposite to the polarity of the charge of the latent image whereby the toner paticles may be more easily removed from the photoconductor surface.

For a better understanding of the invention as well as other objects and further features thereof, reference is made to the detailed description of the invention to be read in connection with the accompanying drawing wherein:

The single FIGURE is a schematic view of a copying apparatus.

Referring to the drawing, there is shown a drum 10 on which a photoconductive layer 12 is formed. Arranged about the drum 10 are a charging station A, an imaging station B, a development station C, a background removal station D, an image transfer and fixing station E and a cleaning station F. All of the functions of these stations are well-known in the art, with the exception of the specific methods and apparatus relating to the background removal station D to which this invention applies. For the purposes of this description, it will be assumed that the charge on the photoconductor is positive, a positive-to-positive reproduction is used and that negative charged toner is employed for developing the image. An electrostatic latent image may be formed on the layer 12 and developed with xerographic toner particles 14 by any means known in the art. The developed image is represented by reference numeral 15.

A toner removal or pick-off apparatus is provided at station D and comprises a magnetic transport assembly generally designated 16 which includes a cylindrical member 18 which houses one or more fixed permanent bar magnets 20. Cylindrical member 18 is made out of any suitable nonmagnetic material and is mounted for rotation on a shaft 22 which is driven in the direction indicated by the arrow by any suitable drive means (not shown). Typical nonmagnetic materials comprise glass or any of the nonmagnetic metals such as brass, stainless steel, aluminum or copper and mixtures thereof.

Arranged on the periphery of cylindrical member 18 is magnetic cleaning material 24 which comprises magnetic beads which can be uncoated or coated as will be explained more fully hereinafter. The magnetic beads comprise any suitable material. This material may be magnetically "soft", i.e., retaining very little residual magnetism, or the permanent magnet type. Typical magnetic materials comprise powdered iron including types known commercially as alcoholized iron and carboxyl iron, steel, nickel, alloys of magnetic iron, such as nickel-iron alloys, nickel-cobalt-iron alloys, and magnetic oxides, such as iron oxide, hematite ($Fe_2O_3$) and mangetite ($Fe_3O_4$) and magnetic ferrites. Typical coating materials are described in U.S. Pat. No. 2,618,551 to Walkup, U.S. Pat. No. 2,618,552 to Wise, U.S. Pat. Re No. 25,136 to Carlson, U.S. Pat. No. 2,874,063 to Greig and U.S. Pat. No. 3,526,533 to Jacknow et al. The materials disclosed in these patents as well as many of the magnetic materials mentioned above, also have a triboelectric attraction for the toner particles for removal of the toner particles onto the beads. Desirably, the magnetic particles are of a size larger than about 30 microns, preferably the same size and size distribution of the carrier used in developing the image for efficient toner pickup. The particles can be supplied from any suitable source such as a tray 26.

To facilitate removal of toner particles onto the magnetic cleaning material 24, the cylindrical member 18 has a variable source of DC potential 28 connected to it so that it tends to electrostatically attract toner from the drum surface. The source of potential desirably ranges from about 200 volts to about 1000 volts and is of the polarity opposite to the polarity of toner particles which, for example, for negative charged toner, would be positive potential. Desirably the cylindrical member 18 has an electrical insulating layer which may be made of any suitable semiconductive material or alternatively, the magnetic beads can be coated with any of the electrically insulating material set forth above.

In order to further enhance the electrostatic attraction of the toner particles onto the magnetic cleaning heads, a corona generating device 30 is positioned in the path of the photoconductor drum 10 just prior to the magnetic transport assembly 16 and emits negative ions to place a negative charge on the toner particles. This charge also reduces the residual background potential and changes the charge on those particles which are positive to negative and renders the negative particles more negative. For instance, the residual background potential of 200 volts may be reduced to 0 volts or even to the extent of reversing the polarity. This reduces the attraction of the toner particles to the surface of the recording element and ensures that the toner particles are properly negatively charged so they will be triboelectrically attracted to the cleaning beads and will also be attracted to the cleaning beads by the field set up by the positive potential applied by DC potential 30 and the background potential. Since the image has already been developed, the toner has the effect of protecting the image from being charged at the same rate as the background and therefore the reduction of the potential at the image portion is minimal compared to the original image potential. Corona device 30 is suitably powered as by a variable source of A.C. or D.C. potential 32 or biased A.C. potential. The voltage on the corona device is adjusted to reduce the background potential as required to optimize the output copy.

It will be appreciated that streamers are formed from the outer surface of cylinder 18 due to the lines of force from magnets 20 which are oriented in polar paths as indicated by the letters N and S, which illustrate north and south poles, respectively. As cylindrical member 18 is rotated about its shaft, streamers or bristles formed by the magnetic cleaning material 24 sweep past drum surface 12 to mechanically, triboelectrically and electrostatically remove toner from the background surface and the image onto the magnetic cleaning beads 24. It should be noted that the bristles of cleaning material are most compact at the drum surface 12 to obtain a somewhat restrained balanced wiping action which will not dislodge a substantial amount of toner particles from the image portion.

With the toner particles being removed from the background of surface 12 and onto the magnetic cleaning material 24, it is essential that these toner particles in turn be removed from the magnetic cleaning material to prevent them from redepositing onto the drum surface. To this end, a bias roll member 34 is positioned in surface contact with the magnetic cleaning material and mounted for rotation on a shaft 36 driven at an appropriate speed in the opposite direction whereby toner material is continuously removed from the magnetic cleaning material onto the bias roll member. In order to accomplish this, the bias roll member is made out of a conductive material and is connected to a source of DC potential 38 which is sufficiently high to set up a field to electrostatically remove the toner material from the magnetic transport and deposit it onto the roll member 34. DC potential 38 ranging from about 500 volts to about 2000 volts of the same polarity as potential source 28 is found to perform well for this purpose. A wiper element 40 is positioned in contact with the bias roll member 34 so as to continuously scrape the toner material from the bias roll thereby depositing the toner material into a catch tray 42 for subsequent reuse in the development system of the copying machine. Any suitable metallic or non-metallic material may be used for the scraper blade.

In operation, negative corona emissions are directed to the photoconductive drum to substantially lower the background potential and render all toner particles in the background area negative. Rotating electrically biased cylindrical member 18 brings the cleaning beads 24 into sweeping contact with the toner particles on the photoconductor surface 12 to mechanically loosen the toner which is then triboelectrically and electrostatically pulled from the surface to the cleaning beads.

Toner particles are removed from both the background portion and the image portion. It has been found that a very low percentage of the toner is removed from high density image areas while a very high percentage of the background toner is removed. The amount of toner removed from the image area has a minimal effect on high density image areas with a definite overall improvement in copy appearance. There is a more noticeable effect on low density image areas with the image becoming lighter, but still there is an overall improvement in copy appearance. As the cylinder 18 continues to rotate, the toner laden cleaning beads are brought adjacent the bias roll member 34 wherein the toner 14 is redeposited onto the bias roll member so as to purge the toner from the cleaning beads enabling the beads to be utilized at full strength continuously. The toner removed onto the bias roll member is deposited into catch tray 42 where it is available for reuse in the development system.

While the cylinder 18 has been described as being biased, this is not necessary in the operation since the mechanical dislodging of the toner particles by the cleaning beads and the triboelectric attraction therefor by the cleaning beads will substantially reduce the background. However, the provision of biasing means on the cylinder 18 is preferred as it renders the system more efficient.

What is claimed is:

1. A method for substantially reducing background on copies made by an electrostatic processor having a photoconductive member for carrying a latent electrostatic image of a predetermined polarity, comprising the successive steps of:

charging a photoconductive member;

exposing said member to a light image to provide said latent electrostatic image;

developing said photoconductive member by applying thereto pre-charged toner particles predominantly of the opposite polarity to said predetermined polarity but containing a small percentage of particles having a polarity the same as said predetermined polarity;

conditioning said photoconductive member and said toner by subjecting said photoconductive member and the developed image thereon to corona emissions of a polarity opposite to said predetermined polarity to concurrently reduce any charge on said background areas of said photoconductive member and to ensure that all toner particles have a charge of an opposite polarity to said predetermined polarity;

selectively removing toner particles from said background areas while allowing toner associated with said image areas to pass substantially unaltered; and transferring said developed image to a copy substrate.

2. The method recited in claim 1 wherein said step of selectively removing comprises wiping said photoconductive surface with cleaning beads having a triboelectric attraction for the toner particles to remove the background toner particles therefrom.

3. The method recited in claim 1 including the further step of establishing an electrostatic field between said beads and said photoconductive member to increase the attraction between said background toner particles and said beads.

* * * * *